United States Patent [19]

Navone

[11] 4,155,328

[45] May 22, 1979

[54] MAGNETIC BRUSH DEVELOPING UNIT FOR ELECTROPHOTOGRAPHIC COPY-MACHINE

[75] Inventor: Lorenzo Navone, Turin, Italy

[73] Assignee: Ing. C. Olivetti & C., S.p.A., Ivrea, Italy

[21] Appl. No.: 829,271

[22] Filed: Aug. 31, 1977

[30] Foreign Application Priority Data

Sep. 22, 1976 [IT] Italy ..... 69272 A/76

[51] Int. Cl.[2] ..... G03G 13/09

[52] U.S. Cl. ..... 118/657; 222/DIG. 1

[58] Field of Search ..... 118/653, 657, 658; 222/DIG. 1; 355/3 DD; 427/18

[56] References Cited

U.S. PATENT DOCUMENTS

| | | | |
|---|---|---|---|
| 2,930,351 | 3/1960 | Giaimo, Jr. | 118/657 |
| 3,547,077 | 12/1970 | Sage | 118/657 |
| 3,575,139 | 4/1971 | Nuzum | 118/658 |
| 4,014,291 | 3/1977 | Davis | 118/657 |
| 4,041,901 | 8/1977 | Rarey et al. | 118/658 |
| 4,081,571 | 3/1978 | Nishihama et al. | 118/657 |

*Primary Examiner*—Mervin Stein
*Attorney, Agent, or Firm*—W. R. Hulbert

[57] ABSTRACT

A magnetic brush developing unit for an electrophotographic copy-machine of the type having a magnetic applicator which moves toner particles along a path passing adjacent the photoconductive element having the latent electrostatic image to be developed, in which a grid having a fine mesh is interposed in this path for separating clots of toner from the toner particles. The clots entrapped in the mesh are vibrated by the magnetic applicator till they are shattered and pass through the mesh.

4 Claims, 2 Drawing Figures

MAGNETIC BRUSH DEVELOPING UNIT FOR ELECTROPHOTOGRAPHIC COPY-MACHINE

BACKGROUND OF THE INVENTION

The present invention relates to a developing unit of the magnetic brush type for an electrophotographic copy-machine, having a cylindrical magnetic applicator carrying on its outer surface particles of one—component-magnetic toner.

The applicator is rotated adjacent to the surface of the photoconductive element of the copy machine, which carries thereon an electrostatic latent image of the original to be copied.

The electrostatic force of attraction of the latent image causes the selective deposition of toner particles, coming from the applicator, onto the surface of the photoconductive element, against the action of the magnetic force of attraction between the applicator and the particles, so developing the latent image.

A draw back which is present by using one component magnetic-toner as developing powder is due to the tendency of the toner particles to stably agglomerate so forming clots having dimensions well greater than that of the single toner particle.

This tendency is affected by the ambient humidity and by the triboelectrical and magnetic characteristics of the toner particle.

Whichever are the causes of the clots formation, a clot has a magnetic force of attraction to the applicator which can be either much less or much greater than that of a single toner particle; in the first case it is possible that some zones of the latent image have an electrostatic charge insufficient to attract a clot and thus these zone are not developed. On the contrary in the second case it is possible that some zones of the photoconductive element be unduly developed thus causing in the copy undesired "background" coloration.

SUMMARY OF THE INVENTION

The technical problem of the present invention is therefore that of providing a magnetic brush developing unit for an electrophotographic copy-machine using a one-component magnetic toner, in which the drawbacks due to the clots formation are eliminated.

This technical problem is solved by a magnetic brush one component toner developing unit, characterized in that it comprises a sieve having mesh well less than the clots dimensions, mounted adjacent the cylindrical applicator in such a manner as to cause the particles carried by the applicator to pass through the mesh at each rotation of the applicator, whereby the clots are entrapped in the sieve.

BRIEF DESCRIPTION OF THE DRAWINGS

This and other objects of the present invention will be clear from the following description of the preferred embodiment with reference to the accompanying drawings in which.

DESCRIPTION OF THE PREFERRED EMBODIMENT

Figure 1:
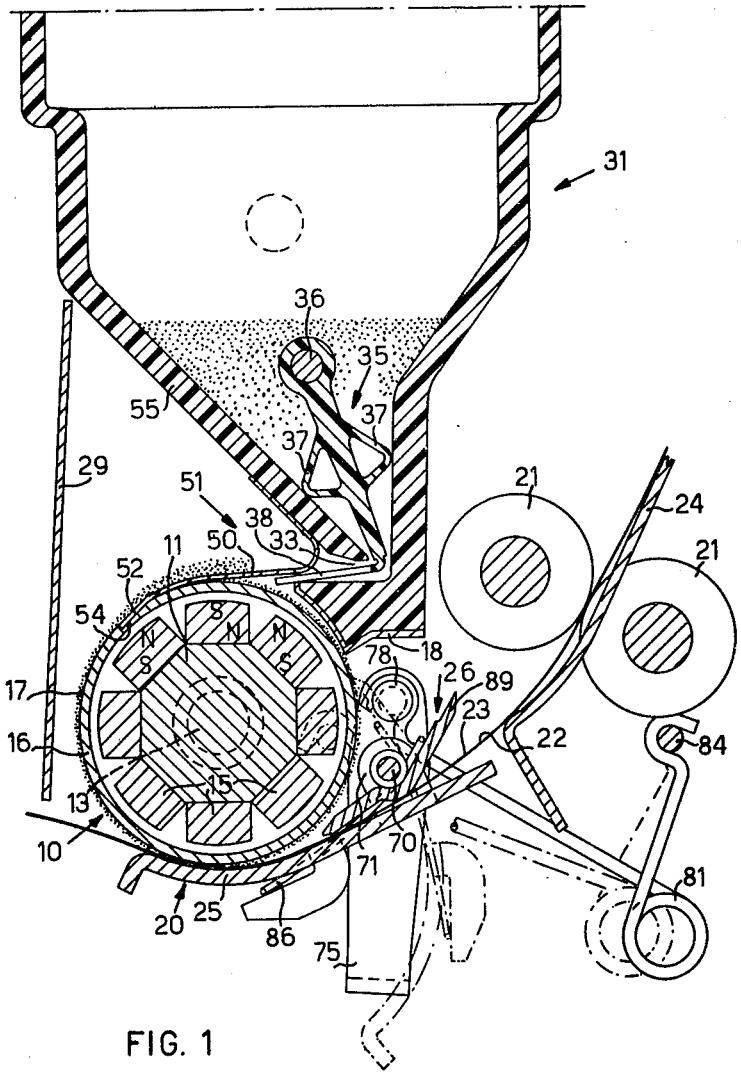
FIG. 1 is a sectional front view of a developing unit according to the invention.

The magnetic brush developing unit of FIG. 1 comprises a cylindrical applicator 10 having an inner element 11 octagonal parallelepiped shaped and jurnalled for rotation on a shaft 13 rotated during the machine operation by a suitable motor not shown in the drawings. A permanent magnet 15 is fixedly mounted on each lateral face of the parallelepiped element 11 and creates a magnetic field having a radial direction with respect to the shaft 13. The polarities of a magnet 15 mounted on a face of the parallelepiped element 11 are opposed to the polarities of the magnets 15 mounted on the two faces adjacent said face. The parallelepiped element 11 and the related magnets 15 are surrounded by a cylindrical shell 16 made of a non magnetic material and fixedly mounted on the machine frame.

The one component toner is attracted on the outer surface 17 of the shell 16 and forms the "bristles" of the magnetic brush which are moved in a clockwise direction by the rotation of the parallelepiped element 11 and of the magnets 15 mounted thereto.

The length of the bristles is maintained constant by the a leveller 19.

During the rotation the bristles come in contact, in the zone 20 with the surface 22 of the photoconductive sheet 23, carrying thereon an electrostatic latent image of the original to be copied, and causes the development thereof.

The photoconductive sheet 23, coming from the exposure station of the machine, is advanced into the developing station towards the zone 20 by the rollers 21 and the guide elements 24, 25 and 26 and after development it is advanced towards a transfer station, in the case of the usual xerographic process, or towards a fixing station in the case of an Electrofax process, which station are mounted on the machine at the left of the panel 29 and not shown in FIG. 1.

A hopper 31, containing a quantity of toner particles sufficient for supplying fresh toner to the "bristles" of the magnetic brush, is mounted over the applicator 10.

Figure 2:
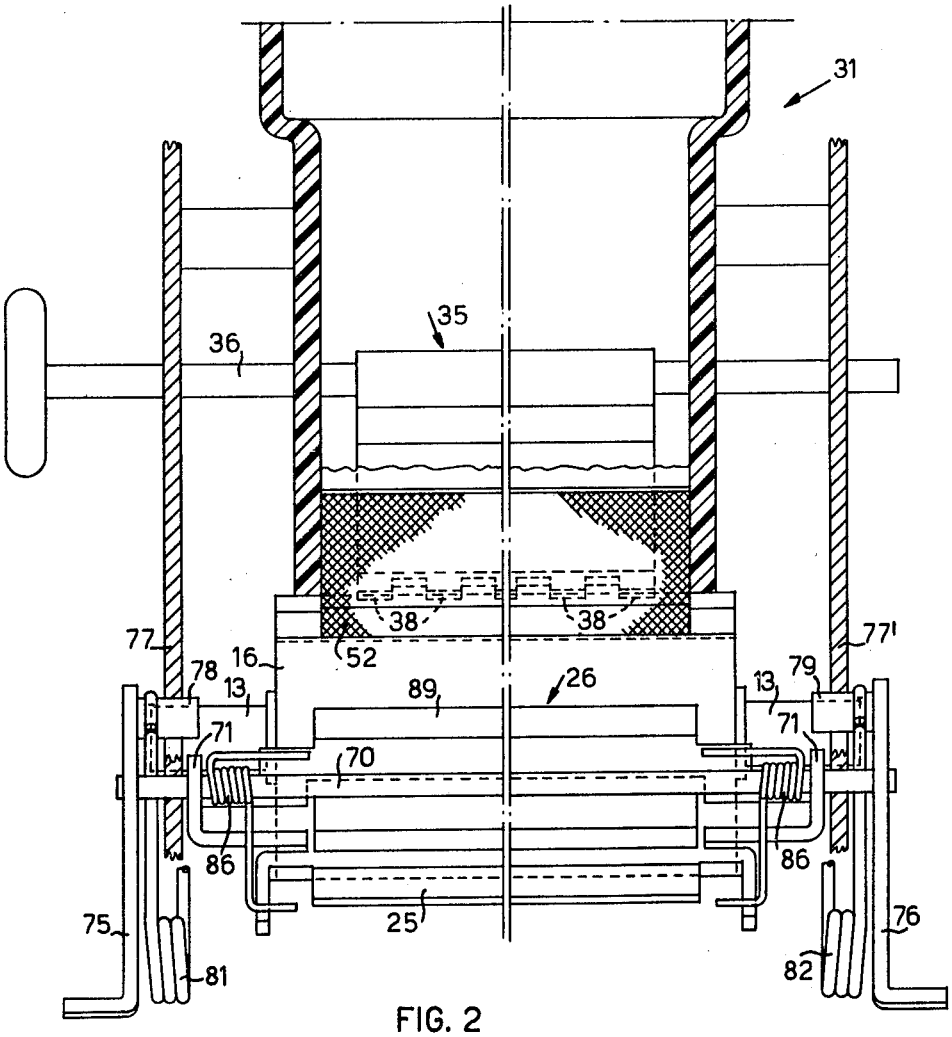
FIG. 2 is a partially sectioned lateral view of the developing unit of FIG. 1 in which the panel 29 has been omitted.

A little quantitiy of toner particles of the hopper 31 falls continuously during operation, onto the outer surface 17 of the shell 16 through the opening 33, by gravity and by magnetic attraction. A dosing-mixer device 35 is mounted inside the hopper 31; it comprises a plurality of tongues 37 and 38 fixedly connected to a stud 36 slidably mounted along its own axis on the walls 77 and 77' of the machine frame (FIG. 2).

The sliding of the stud 36 can be affected by the knob 40 and it causes, by the tongues 37 and 38, the mixing of the toner particles and the fall of a little quantity of them onto the outer surface 17 of the shell 16.

The mixing action of the tongues 37 and 38 prevents the formation of clots in the hopper 31.

According to a feature of the present invention, a grid 50 is mounted in the zone 51 (FIG. 1) located between the opening 33 of the hopper 31 and the shell 16. The grid 50, has an end fixed to the shell 16 in a groove 54 of its outer surface 17, is partially wound on the surface 17, extends near the opening 33 of the hopper 31, and has the other end fixed to a wall 55 of the hopper 31.

The grid 50 is made of a non magnetic material and has a mesh in the range of 0.2–0.3 mm, which is less than the dimension of the clots.

Due to the grid 50, the toner particles rotated on the outer surface 17 of the shell 16 by the action of the magnet 15, are forced in the zone 51, to come out from the surface 17 and to pass on the grid 50 thus allowing the toner particles not agglomerated to fall through the mesh of the grid again on to the surface 17, and the clots to be entrapped on the mesh of the grid 50.

The clots entrapped on the grid are continuously vibrated by the alternating magnetic action of the magnets 15 rotated thereunder, each magnet is followed by a magnet of opposite polarity which affect the clots in a reverse manner with respect to the preceding magnet.

The vibration of the clots causes the shattering of the same in more little particles which pass through the mesh of the grid 50 and return to form the bristles of the brush.

Since a portion of the grid 50 is located adjacent the opening 33 of the hopper 31 a similar effect takes place also for the clots coming from the hopper 31.

It is clear that the combination of the grid 50 and the rotation of the magnets 15 act as a sieve for the clots of toner.

According to another aspect of the present invention the guide element 25 is pivotally mounted on a stud 70 by means of tongues 71, and the guiding element 26 is fixedly mounted to the stud 70, the pin 70 is rotatably mounted on the walls 77 on 77' of the machine frame.

A pair of levels 75 and 76 is fulcrumed to the stud 70 and is fixed thereto.

The levers 75 and 76 have pins 78 and respectively 79 fixed thereto.

A pair of springs 81 and 82 is connected between the pins 78 and respectively 79 of the levers 75 and 76, and the pins 84 fixed to the machine frame.

The springs 81 and 82 hold the levers 75 and 76 and the guide elements 25 and 26 in a first stable operative position, indicated by full line in FIGS. 1 and 2.

A spring 86 is connected between the guide elements 25 and 26 and maintain them at a relative distance suitable for allowing a photo conductive sheet to pass therebetween.

The guide element 26 has a sharp end 89 which is used as a scraper.

In order to clear the shell 16 from the toner particles, during the operations of machine maintenance or of toner replenishment the levers 75 and 76 are turnable in a anticlockwise direction (with respect to FIG. 1) against the action of the springs 81 and 82 till a second stable operative position, indicated with dashed line in FIG. 1, causing a similar rotation of the guiding element 26.

In the second operative position the sharp end 89 of the guiding element 26 scrapes the outer surface 17 of the shell 16 and causes the fall of the toner particles, moved thereon, into a suitable container positioned under the applicator 10 and not shown in the drawings.

Certain modifications and improvement of the instant invention will be apparent to those of skill in the art and the claims are intended to cover all such modifications and improvements which do not depart from the spirit and the scope of the invention.

What is claimed is:

1. A developing unit for selectively applying magnetic toner particles onto the surface of a photoconductive element having a latent electrostatic image comprising:

a magnetic applicator, positioned adjacent to the photoconductive element, having at least a pair of magnetic poles of opposite polarity, mounted for rotation around a given axis, and a non-magnetic cylindrical shell surrounding said poles, for carrying on its outer surface magnetic toner particles held thereon by the magnetic force of attraction of said poles;

means for rotating said magnetic poles around said axis to rotate the toner particles along said outer surface and to apply them to the photoconductive element;

a hopper, for containing toner particles, mounted over said applicator having an opening through which the toner particles fall onto said shell;

and a grid having a fine mesh and having an end connected to said shell and the other end connected to the hopper proximate said opening, for entrapping clots of toner particles coming out from said hopper or moving on said shell.

2. A developing unit for selectively applying toner particles to a surface of a photoconductive sheet having a latent electrostatic image to be developed comprising: a magnetic applicator for carrying toner particles, attracted thereto by magnetic action, along a closed path passing adjacent to said photoconductive sheet in a developing zone; a grid having a fine mesh interposed in said path for entrapping clots of said toner particles; a guiding element for guiding said photoconductive sheet in said developing zone, said guiding element having a sharp end; and means mounting said guiding element for selectively moving said element between a guiding position and a scraping position in which said sharp end scrapes the surface of the applicator for detaching toner particles attracted thereto.

3. A developing unit for applying toner particles in a developing zone to a photoconductive sheet having a latent electrostatic image to be developed comprising: a magnetic applicator for carrying toner particles, attracted thereto by magnetic action, along a closed path passing through said developing zone, a guiding element for guiding the photoconductive sheet in said developing zone; said guiding element having a sharp end; and means mounting said guiding element for selectively moving said element between a guiding position and a scraping position in which said sharp end scrapes the surface of said applicator for detaching toner particles attracted thereto.

4. In a developing unit for an electrophotographic copying machine of the type having a magnetic applicator including at least two magnetic poles of opposite polarity rotated around a common axis for moving magnetic toner particles along a path passing adjacent to a photoconductive element having a latent electrostatic image to be developed, and a grid having a fine mesh interposed in said path for entrapping thereon clots of said magnetic toner particles to take out said clots from said path, the improvement which comprises: means mounting said grid adjacent to said magnetic applicator in a position in which the rotation of said magnetic poles of opposite polarity causes vibration on said grid of said entrapped clots for shattering them and which allows said shattered clots to be moved in said path by passing through said grid.

* * * * *